US011676753B2

(12) United States Patent
Hwang et al.

(10) Patent No.: US 11,676,753 B2
(45) Date of Patent: Jun. 13, 2023

(54) COIL COMPONENT

(71) Applicant: SAMSUNG ELECTRO-MECHANICS CO., LTD., Suwon-si (KR)

(72) Inventors: Ji Hoon Hwang, Suwon-si (KR); Myoung Ki Shin, Suwon-si (KR); Jeong Gu Yeo, Suwon-si (KR); Young Il Lee, Suwon-si (KR); Byeong Cheol Moon, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 363 days.

(21) Appl. No.: 16/943,474

(22) Filed: Jul. 30, 2020

(65) Prior Publication Data

US 2021/0350964 A1 Nov. 11, 2021

(30) Foreign Application Priority Data

May 8, 2020 (KR) ..... 10-2020-0055432

(51) Int. Cl.

| | |
|---|---|
| ***H01F 17/00*** | (2006.01) |
| ***H01F 17/04*** | (2006.01) |
| ***H01F 27/29*** | (2006.01) |
| ***H01F 27/32*** | (2006.01) |

(52) U.S. Cl.

CPC ..... *H01F 17/0013* (2013.01); *H01F 17/04* (2013.01); *H01F 27/292* (2013.01); *H01F 27/324* (2013.01); *H01F 2017/048* (2013.01)

(58) Field of Classification Search

CPC .... H01F 17/0013; H01F 17/04; H01F 27/292; H01F 27/324; H01F 2017/048

See application file for complete search history.

(56) References Cited

U.S. PATENT DOCUMENTS

| | | | | |
|---|---|---|---|---|
| 2004/0108934 | A1 | 6/2004 | Choi et al. | |
| 2013/0169404 | A1* | 7/2013 | Jeong | H01F 27/2804 336/200 |
| 2013/0249645 | A1* | 9/2013 | Kim | H01F 17/0013 156/89.12 |

(Continued)

FOREIGN PATENT DOCUMENTS

| | | | |
|---|---|---|---|
| KR | 2004-311944 | A | 11/2004 |
| KR | 10-2013-0076285 | A | 7/2013 |

(Continued)

OTHER PUBLICATIONS

Office Action issued in corresponding Korean Patent Application No. 10-2020-0055432 dated Aug. 2, 2021, with English translation.

*Primary Examiner* — Mohamad A Musleh
*Assistant Examiner* — Malcolm Barnes
(74) *Attorney, Agent, or Firm* — Morgan, Lewis & Bockius LLP

(57) ABSTRACT

A coil component includes a support substrate, a coil portion disposed on at least one surface of the support substrate, a magnetic body, in which the support substrate and the coil portion are disposed, having a through-portion penetrating through a center of the coil portion, a nonmagnetic layer disposed below the through-portion, and an insulating layer disposed between the nonmagnetic layer and the through-portion.

18 Claims, 6 Drawing Sheets

(56) References Cited

U.S. PATENT DOCUMENTS

| | | | | |
|---|---|---|---|---|
| 2014/0062636 | A1* | 3/2014 | Yang | H01F 27/02 336/83 |
| 2015/0123757 | A1* | 5/2015 | Choi | H01F 41/046 29/609 |
| 2015/0325510 | A1* | 11/2015 | Choi | H01L 23/49827 257/774 |
| 2016/0293320 | A1* | 10/2016 | Kim | H01F 27/32 |
| 2018/0033541 | A1* | 2/2018 | Hong | H01F 41/041 |
| 2018/0068775 | A1* | 3/2018 | Kwon | H01F 27/292 |
| 2019/0006088 | A1* | 1/2019 | Tomonari | H01F 27/2847 |
| 2019/0088402 | A1* | 3/2019 | Kim | H01F 27/29 |
| 2019/0115146 | A1* | 4/2019 | Kwon | H01F 1/147 |
| 2019/0122810 | A1* | 4/2019 | Oh | H01F 17/0013 |
| 2020/0013729 | A1* | 1/2020 | Washida | H01F 17/0013 |
| 2020/0118730 | A1 | 4/2020 | Ryu et al. | |
| 2020/0365315 | A1* | 11/2020 | Kim | H01F 27/292 |
| 2020/0373064 | A1* | 11/2020 | Asai | H01F 27/324 |

FOREIGN PATENT DOCUMENTS

| | | | |
|---|---|---|---|
| KR | 10-2018-0013072 | A | 2/2018 |
| KR | 10-2016483 | B1 | 9/2019 |
| KR | 10-2020-0041695 | A | 4/2020 |

* cited by examiner

COIL COMPONENT

CROSS-REFERENCE TO RELATED APPLICATION(S)

This application claims the benefit under 35 USC 119(a) of Korean Patent Application No. 10-2020-0055432 filed on May 8, 2020 in the Korean Intellectual Property Office, the entire disclosure of which is incorporated herein by reference for all purposes.

TECHNICAL FIELD

The present disclosure relates to a coil component.

BACKGROUND

An inductor, a coil component, is a typical passive electronic component used in electronic devices, along with a resistor and a capacitor.

As electronic devices tend to have higher performance and to be smaller, coil components used in electronic devices may be increased in number and decreased in size. Accordingly, there have been continuous developments in a thin-film inductor in which a coil portion is formed on a substrate by plating, a coil formed on the substrate is embedded with a magnetic material sheet, and an external electrode is formed on an external surface of a magnetic body.

A thin-film inductor has been manufactured in such a manner that a saturation magnetization value Ms or a grain size distribution of magnetic powder is changed to adjust DC-bias characteristics.

There is a need to adjust DC-bias characteristics and to decrease flux saturation velocity by appropriately increasing resistance of a component, other than the above-described method of changing material properties of a magnetic powder.

SUMMARY

An aspect of the present disclosure is to a coil component, capable of decreasing flux saturation velocity and implementing target DC-bias characteristics without changing a material of a body.

According to an aspect of the present disclosure, a coil component includes a support substrate, a coil portion disposed on at least one surface of the support substrate, a magnetic body, in which the support substrate and the coil portion are disposed, having a through-portion penetrating through a center of the coil portion, a nonmagnetic layer disposed below the through-portion, and an insulating layer disposed between the nonmagnetic layer and the through-portion.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
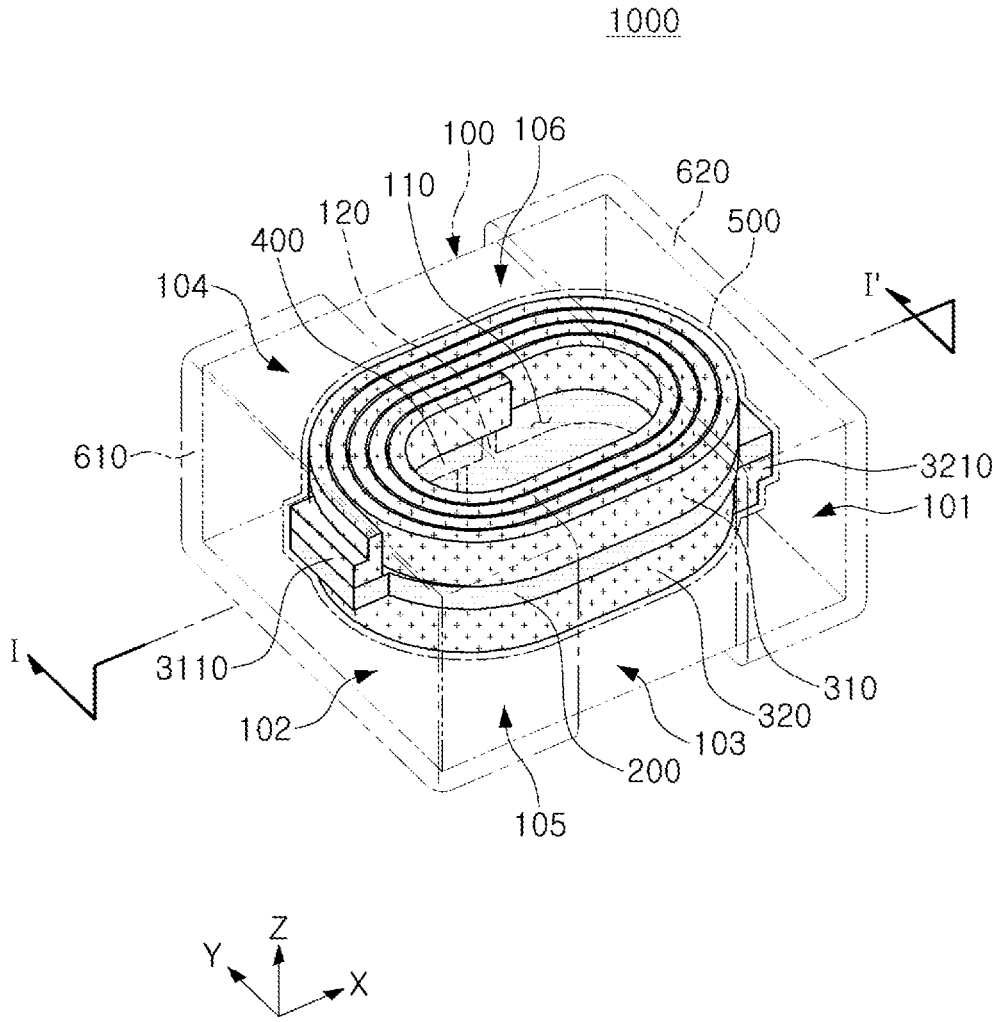
FIG. 1 is a schematic diagram of a coil component according to a first embodiment of the present disclosure.

The following detailed description is provided to assist the reader in gaining a comprehensive understanding of the methods, apparatuses, and/or systems described herein However, various changes, modifications, and equivalents of the methods, apparatuses, and/or systems described herein will be apparent to one of ordinary skill in the art. The sequences of operations described herein are merely examples, and are not limited to those set forth herein, but may be changed as will be apparent to one of ordinary skill in the art, with the exception of operations necessarily occurring in a certain order. Also, descriptions of functions and constructions that would be well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will fully convey the scope of the disclosure to one of ordinary skill in the art.

Herein, it is noted that use of the term "may" with respect to an example or embodiment, e.g., as to what an example or embodiment may include or implement, means that at least one example or embodiment exists in which such a feature is included or implemented while all examples and embodiments are not limited thereto.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there may be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as illustrated in the figures. Such spatially relative terms are intended to encompass different orientations of the device in use or operation in addition to the orientation depicted in the figures. For example, if the device in the figures is turned over, an element described as being "above"

or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes illustrated in the drawings may occur. Thus, the examples described herein are not limited to the specific shapes illustrated in the drawings, but include changes in shape occurring during manufacturing.

The features of the examples described herein may be combined in various ways as will be apparent after gaining an understanding of the disclosure of this application. Further, although the examples described herein have a variety of configurations, other configurations are possible, as will be apparent after gaining an understanding of the disclosure of this application.

The drawings may not be to scale, and the relative size, proportions, and depiction of elements in the drawings may be exaggerated for clarity, illustration, and convenience.

A value used to describe a parameter such as a 1-D dimension of an element including, but not limited to, "length," "width," "thickness," "diameter," "distance," "gap," and/or "size," a 2-D dimension of an element including, but not limited to, "area" and/or "size," a 3-D dimension of an element including, but not limited to, "volume" and/or "size", and a property of an element including, not limited to, "roughness," "density," "weight," "weight ratio," and/or "molar ratio" may be obtained by the method(s) and/or the tool(s) described in the present disclosure. The present disclosure, however, is not limited thereto. Other methods and/or tools appreciated by one of ordinary skill in the art, even if not described in the present disclosure, may also be used.

In the drawings, the X direction may be defined as a first direction or a longitudinal direction, a Y direction as a second direction or a width direction, and a Z direction as a third direction or a thickness direction.

Hereinafter, a coil component according to an exemplary embodiment will be described in detail with reference to the accompanying drawings, and in describing with reference to the accompanying drawings, the same or corresponding components are assigned the same reference numbers, and overlapped descriptions thereof will be omitted.

Various types of electronic components are used in electronic devices, and various types of coil components may be appropriately used to remove noise between the electronic components.

For example, in electronic devices, coil components may be used as power inductors, high-frequency (HF) inductors, general beads, high-frequency beads (GHz Beads), and common mode filters

First Embodiment

Figure 2:
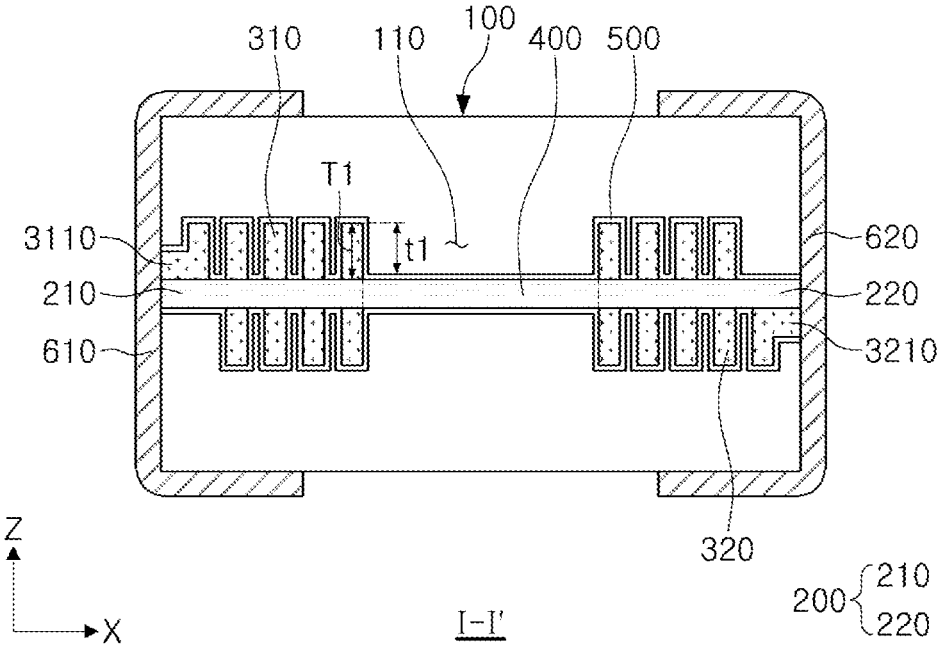
FIG. 2 is a cross-sectional view taken along line I-I' in FIG. 1.

FIG. 1 is a schematic diagram of a coil component according to a first embodiment, and FIG. 2 is a cross-sectional view taken along line I-I' in FIG. 1.

Referring to FIGS. 1 and 2, a coil component 1000 according to the first embodiment may include a body 100, a support substrate 200, and coil portions 310 and 320, a nonmagnetic layer 400, and an insulating layer 500, and may further include external electrodes 610 and 620.

The support substrate 200 may be disposed inside of the body 100 to be described hereinafter and may support first and second coil portions 310 and 320. Referring to FIG. 2, the support substrate 200 includes a first support portion 210 disposed to be adjacent to an end portion 3110 of the first coil portion 310 based on a through-portion 110 to be described hereinafter and supporting the first coil portion 310 and the second coil portion 320. In addition, the support substrate 200 includes a second support portion 220 disposed to be adjacent to an end portion 3210 of the second coil portion 320 based on the through-portion 110 and supporting the first coil portion 310 and the second coil portion 320.

The support substrate 200 may be formed of an insulating material including a thermosetting insulating resin such as an epoxy resin, a thermoplastic insulating resin such as polyimide, or a photosensitive insulating resin, or may be formed of an insulating material in which a reinforcing material such as a glass fiber or an inorganic filler is impregnated with such an insulating resin. For example, the support substrate 200 may be formed of an insulating material such as prepreg, Ajinomoto Build-up Film (ABF), FR-4, a bismaleimide triazine (BT) film, a photoimageable dielectric (PID) film, and the like, but the present disclosure is not limited thereto.

The inorganic filler may be at least one or more selected from a group consisting of silica ($SiO_2$), alumina ($Al_2O_3$), silicon carbide (SiC), barium sulfate ($BaSO_4$), talc, mud, a mica powder, aluminum hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$).

When the support substrate 200 is formed of an insulating material including a reinforcing material, the support substrate 200 may provide better rigidity. When the support substrate 200 is formed of an insulating material not including glass fibers, the support substrate 200 may be advantageous for thinning the overall coil portions 310 and 320.

In this embodiment, a central portion of the support substrate 200 remains without penetrating through the central portion. The remaining central portion of the support substrate 200 forms a through-hole, not illustrated. The through-hole, not illustrated, is filled with a magnetic material of the body 100 to be described hereinafter to form a through-portion 110. Likewise, the through-portion 110 filled with a magnetic material may be formed to improve performance of an inductor. The through-portion 110 penetrates through centers of the coil portions 310 and 320 to be described hereinafter, and is disposed above or below the support substrate 200 based on a thickness direction Z. In this embodiment, for ease of description, a portion above the support substrate 200 will be referred to as a through-portion 110, and a region of the portion above the support substrate 200, closest to the nonmagnetic layer 400, will be referred to as a lower portion of the through-portion 110. However, the description of the through-portion 110 may be equally applied to a description of a portion below the through-portion 110. For example, the portion below the support substrate 200 may be referred to as a through-portion 110, and a region of the portion below the support substrate 200, closest to the nonmagnetic layer 400, may be referred to as an upper portion of the through-portion 110.

The body 100 may form an exterior of the coil component 1000 according to this embodiment The body 100 may be formed to have a hexahedral shape overall.

Based on FIG. 1, the body 100 may have a first surface 101 and a second surface 102 opposing each other in a length direction X, a third surface 103 and a fourth surface 104 opposing each other in a width direction Y, and a fifth surface 105 and a sixth surface 106 opposing each other in a thickness direction Z. As an example, the body 100 may be formed such that the coil component 1000 of this embodiment, in which first and second external electrodes 610 and 620 to be described hereinafter are formed, has a length of 1.6 mm, a width of 0.8 mm, and a thickness of 0.8 mm or less, a length of 1.0 mm, a width of 0.6 mm, and a thickness of 0.8 mm or less, or a length of 0.8 mm, a width of 0.4 mm, and a thickness of 0.65 mm or less, but the present disclosure is not limited thereto. Since the above-mentioned values are just design values which do not reflect a process error or the like, even a range recognizable as the process error should be considered to be within the range of the present disclosure.

The body 100 embeds the support substrate 200 and the coil portions 310 and 320 to be described hereinafter therein, and includes the through-portion 110 penetrating through the centers of the coil portions 310 and 320.

The body 100 may include a magnetic material and an insulating resin. Specifically, the body 100 may be formed by laminating at least one magnetic composite sheet including an insulating resin and a magnetic material dispersed in the resin. However, the body 100 may have a structure other than the structure in which the magnetic material may be dispersed in the resin. For example, the body 100 may be formed of a magnetic material such as ferrite.

The magnetic material may be, for example, a ferrite powder particle or a magnetic metal powder particle. Examples of the ferrite powder particle may include at least one or more of spinel type ferrites such as Mg—Zn-based ferrite, Mn—Zn-based ferrite, Mn—Mg-based ferrite, Cu—Zn-based ferrite, Mg—Mn—Sr-based ferrite, Ni—Zn-based ferrite, and the like, hexagonal ferrites such as Ba—Zn-based ferrite, Ba—Mg-based ferrite, Ba—Ni-based ferrite, Ba—Co-based ferrite, Ba—Ni—Co-based ferrite, and the like, garnet type ferrites such as Y-based ferrite, and the like, and Li-based ferrites. In addition, the magnetic metal powder particle, included in the body 100, may include one or more selected from the group consisting of iron (Fe), silicon (Si), chromium (Cr), cobalt (Co), molybdenum (Mo), aluminum (Al), niobium (Nb), copper (Cu), and nickel (Ni). For example, the magnetic metal powder particle may be at least one of a pure iron powder, a Fe—Si-based alloy powder, a Fe—Si—Al-based alloy powder, a Fe—Ni-based alloy powder, a Fe—Ni—Mo-based alloy powder, a Fe—Ni—Mo—Cu-based alloy powder, a Fe—Co-based alloy powder, a Fe—Ni—Co-based alloy powder, a Fe—Cr-based alloy powder, a Fe—Cr—Si-based alloy powder, a Fe—Si—Cu—Nb-based alloy powder, a Fe—Ni—Cr-based alloy powder, and a Fe—Cr—Al-based alloy powder. In this case, the metallic magnetic material may be amorphous or crystalline. For example, the magnetic metal powder particle may be a Fe—Si—B—Cr-based amorphous alloy powder, but the present disclosure is not limited thereto. Each of the ferrite powder and the magnetic metal powder particle may have an average diameter of about 0.1 μm to 30 μm, but the present disclosure is not limited thereto.

The body 100 may include two or more types of magnetic materials dispersed in an insulating resin. In this case, the term "different types of magnetic material" means that the magnetic materials dispersed in the insulating resin are distinguished from each other by one of an average diameter, a composition, crystallinity, and a shape. The insulating resin may include an epoxy, a polyimide, a liquid crystal polymer, or the like, in single form or in combined form, but the preset disclosure is not limited thereto.

The coil portions 310 and 320 are disposed on at least one surface of the support substrate 200 and express characteristics of the coil component. For example, when the coil component 1000 of this embodiment is used as a power inductor, the coil portions 310 and 320 may store an electric field as a magnetic field to maintain an output voltage, and thus, may stabilize power of an electronic device.

Referring to FIGS. 1 and 2, the first and second coil portions 310 and 320 are disposed on one surface and the other surface of the support substrate 200 opposing each other, respectively. The first coil portion 310 may be disposed on one surface of the support substrate 200 and may oppose the second coil portion 320 disposed on the other surface of the support substrate 200. The first and second coil portions 310 and 320 may be electrically connected to each other by a via electrode 120 penetrating through the support substrate 200. Each of the first coil portion 310 and the second coil portion 320 may have a planar spiral shape in which at least one turn is formed around the through-portion 110. As an example, the first coil portion 310 may form at least one turn about an axis of the through-portion 110 on the one surface of the support substrate 200.

Referring to FIGS. 1 and 2, the first and second coil portions 310 and 320 and the first and second external electrodes 610 and 620 to be described hereinafter may be respectively connected through the end portions 3110 and 3210 of the first and second coil portions 310 and 320 disposed in the body 100. For example, the end portions 3110 and 3210 of the first and second coil portions 310 and 320 may function as input terminals or output terminals of the coil component 1000.

At least one of the first coil portion 310, the end portion 3110 of the first coil portion 310, and the via electrode 120 may include at least one conductive layer. As an example, when the first coil portion 310, the end portion 3110 of the first coil portion 310, and the via electrode 120 are formed on one surface of the support substrate 200 by plating, each of the first coil portion 310, the end portion 3110 of the first coil portion 310, and the via electrode 120 may include a seed layer and a plating layer. The seed layer may be formed by an electroless plating method or a vapor deposition method such as sputtering or the like. The seed layer is formed overall along a shape of the first coil portion 310. A thickness of the seed layer is not limited, but the seed layer is formed to be thinner than the plating layer. Then, the plating layer may be disposed on the seed layer. As a non-limiting example, the plating layer may be formed using electroplating. Each of the seed layer and the plating layer may have a single-layer structure or a multilayer structure. The plating layer having a multilayer structure may be formed to have a conformal film structure in which one plating layer is covered with another plating layer, or may be formed to have a shape in which one plating layer is laminated on only one surface of another plating layer.

The first coil portion 310, the end portion 3110 of the first coil portion 310, and the via electrode 120 may be integrally formed, such that boundaries therebetween may not be formed. However, since this is just an example, a case in which the above-described configurations are formed in different steps to form boundaries therebetween is not excluded in the scope of the present disclosure. In this embodiment, for ease of description, descriptions will be given of the first coil portion 310 and the end portion 3110 of the first coil portion 310, but may be equally applied to a second coil portion 320 and the end portion 3210 of the second coil portion 320.

The seed layer and the plating layer of each of the first coil portion 310, the end portion 3110 of the first coil portion 310, and the via electrode 120 may be formed of a conductive material such as copper (Cu), aluminum (Al), silver (Ag), tin (Sn), gold (Au), nickel (Ni), lead (Pb), titanium (Ti), molybdenum (Mo), or alloys thereof, but the present disclosure is not limited thereto.

The nonmagnetic layer 400 is disposed below the through-portion 110.

Referring to FIGS. 1 and 2, thicknesses of the support substrate 200 and the nonmagnetic layer 400 are substantially the same. As will be described hereinafter, since the support substrate 200 itself is directly used as the nonmagnetic layer 400, the thicknesses of the support substrate 200 and the nonmagnetic layer 400 may be the same, or substantially the same in consideration of a measurement error or tolerance recognizable by one of ordinary skill in the art. For example, the thickness of the support substrate 200 may be measured by measuring a thickness of a cross section of a CCL using an optical microscope. In addition, the thickness of the nonmagnetic layer 400 may also be measured by measuring a thickness of a cross section of the nonmagnetic layer 400 using an optical microscope. The thickness of the support substrate 200 may have a median of 10 μm or more to 60 μm or less. The thickness of the support substrate 200 is measured by measuring a maximum value and a minimum value of the thickness of the support substrate 200 and calculating a median of the maximum and minimum values. The thickness of the nonmagnetic layer 400 is also measured by measuring a maximum value and a minimum value of the thickness of the nonmagnetic layer 400 and calculating a median of the maximum and minimum values.

A material of the nonmagnetic layer 400 is not necessarily limited, and the nonmagnetic layer 400 may include one selected from the group consisting of Ajinomoto Build-up Film (ABF), a polymer, a ceramic material, alumina ($Al_2O_3$), and the like. In one example, the nonmagnetic layer 400 may indicate a portion without a magnetic particle or may include a composition different from the body 100.

In this embodiment, the nonmagnetic layer 400 is formed below the through-portion 110. The body 100, included in the coil component 1000, includes magnetic metal powder particles. In a certain case, a saturation magnetization value Ms of the magnetic powder particles or the content of fine particles may be increased to adjust DC-bias characteristics. In addition to such a case, there is a need to decrease magnetic flux saturation velocity and adjust DC-bias characteristics by introducing a gap structure into the through-portion 110. Accordingly, in this embodiment, the DC-bias characteristics are desired to be adjusted by introducing the nonmagnetic layer 400 into a predetermined location in the through-portion 110. In addition, the support substrate 200 itself may be used as the nonmagnetic layer 400*a* by omitting a trimming process on the support substrate 200 disposed below the through-portion 110. As a result, target DC-bias characteristics may be implemented by appropriately increasing magnetic resistance of the component while using the manufacturing process according to the related art as it is.

The insulating layer 500 is disposed between the nonmagnetic layer 400 and the through-portion 110.

Referring to FIG. 2, based on a thickness direction Z of the body 100, a distance T1 from one surface of the support substrate 200 to an upper surface of the first coil portion 310 is greater than a distance t1 from a portion of an insulating layer 500 disposed on the nonmagnetic layer 400 to the upper surface of the first coil portion 310. Although not illustrated in detail, based on the thickness direction Z of the body 100, a distance from the other surface of the support substrate 200 to a lower surface of the second coil portion 320 is also greater than a distance from the insulating layer 500 to the lower surface of the second coil portion 320. In this embodiment, the distance T1 from one surface of the support substrate 200 to the upper surface of the first coil portion 310 may be measured by measuring a thickness of a cross section of the first coil portion 310 using an optical microscope. A thickness of the first coil portion 310 may be measured by measuring a maximum value and a minimum value of the first coil portion 310 and calculating a median of the maximum and minimum values. In addition, the distance t1 from the insulating layer 500 to the upper surface of the first coil portion 310 may be measured by measuring a thickness of a cross section of the insulating layer 500 using an optical microscope. For example, the distance t1 is measured as a value obtained by subtracting the thickness of the cross-section of the insulating layer 500 from the above-mentioned thickness of the cross section of the first coil portion 310. The thickness of the cross section of the insulating layer 500 may be measured by measuring a maximum value and a minimum value of the thickness of the cross section of the insulating layer 500 and calculating a median of the minimum and maximum values. In this embodiment, for ease of description, the detailed description has been given of the first coil portion 310, but the description of the first coil portion 310 may be equally applied to the second coil portion 320.

The insulating layer 500 is formed along the surfaces of the coil portions 310 and 320. For example, the insulating layer 500 may be formed by vapor deposition, or the like, of an insulating material such as parylene.

In this embodiment, the insulating layer 500 is formed on at least one surface of the nonmagnetic layer 400 to increase the thickness of the support substrate 200. Since the resistance of the component is increased as the thickness of the nonmagnetic layer 400 is increased, flux saturation velocity may be decreased to improve the DC-bias characteristics. In addition, the insulating layer 500 may be formed on the support substrate 200 and the nonmagnetic layer 400 in a batch, and thus, the nonmagnetic layer 400 may be disposed on the through-portion 110 without performing an additional process.

The external electrodes 610 and 620 are disposed on the external surfaces of the body 100 and are connected to the end portions 3110 and 3210 of the coil portions 310 and 320, respectively. Referring to FIGS. 1 and 2, the first external electrode 610 is disposed on the second surface 102 of the body 100 to be connected to the end portion 3110 of the first coil portion 310, and the second external electrode 620 is disposed on the first surface 101 of the body 100 to be connected to the end portion 3210 of the second coil portion 320.

The external electrodes 610 and 620 electrically connect the coil component 1000 according to this embodiment to a printed circuit board, or the like, when the coil component 1000 is mounted on the printed circuit board, or the like.

The external electrodes 610 and 620 may include at least one of a conductive resin layer and an electroplating layer. The conductive resin layer may be formed by printing a conductive paste on the surface of the body 100 and curing the printed conductive paste. The conductive paste may include at least one of conductive metals selected from the group consisting of copper (Cu), nickel (Ni), and silver (Ag) and a thermosetting resin. The electroplating layer may include at least one selected from the group consisting of nickel (Ni), copper (Cu), and tin (Sn). In this embodiment, the external electrodes 610 and 620 may include a first layer, not illustrated, formed on the surface of the body 100 to be in direct contact with the end portions 3110 and 3210 of the first and second coil portions 310 and 320 and a second layer, not illustrated, disposed on the first layer. As an example, the first layer may be a nickel (Ni) plating layer and the second layer may be a tin (Sn) plating layer, but the present disclosure is not limited thereto.

Second Embodiment

Figure 3:
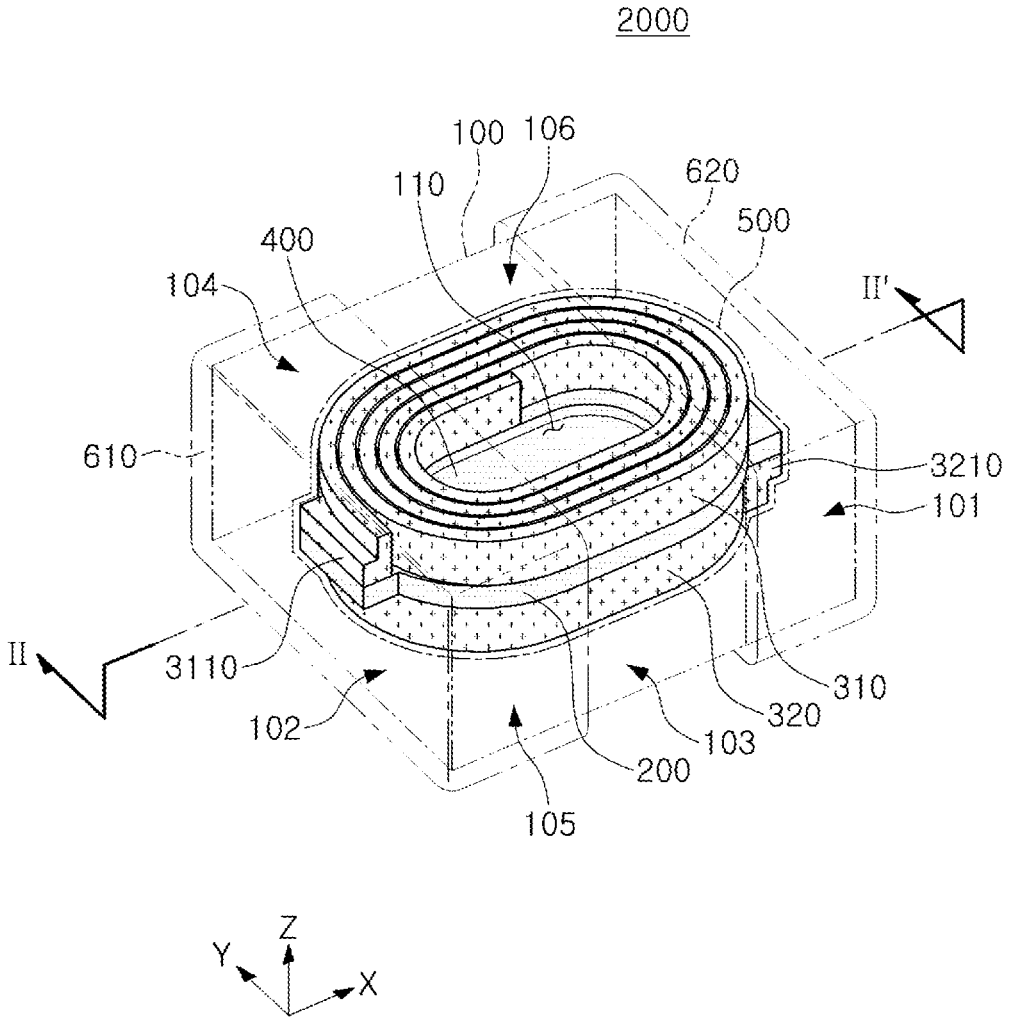
FIG. 3 is a schematic diagram of a coil component according to a second embodiment of the present disclosure.
Figure 4:
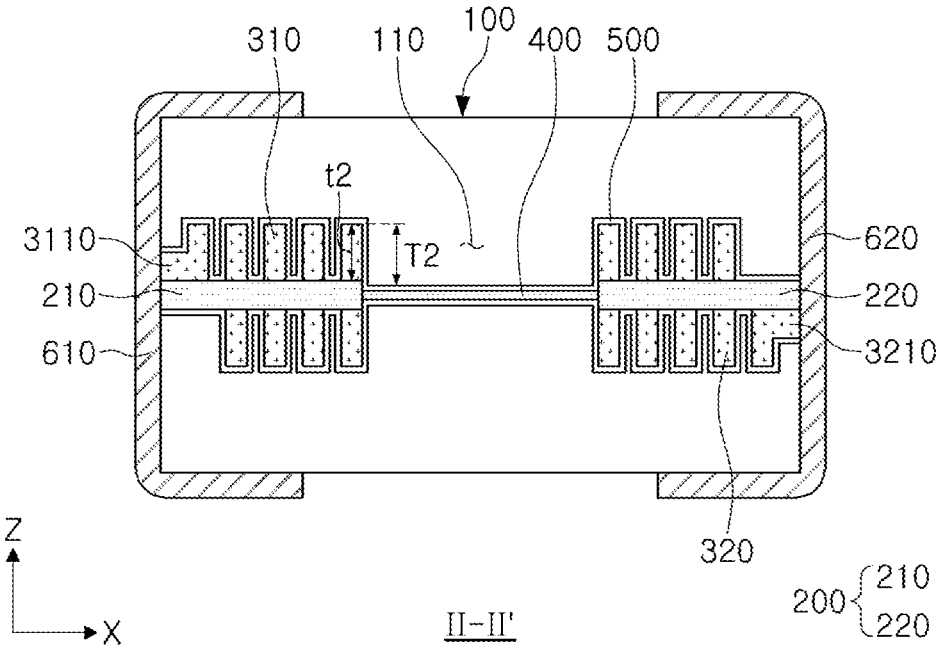
FIG. 4 is a cross-sectional view taken along line II-II' in FIG. 3.

FIG. 3 is a schematic diagram of a coil component according to a second embodiment, and FIG. 4 is a cross-sectional view taken along line II-II' in FIG. 3.

A coil component 2000 according to this embodiment is different from the coil component 1000 according to the first embodiment, in terms of a method of forming a nonmagnetic layer 400 and a thickness of the nonmagnetic layer 400. Therefore, a description will be given of only the method of forming the nonmagnetic layer 400 and the thickness of the nonmagnetic layer 400 different from those in the first embodiment. The description of the first embodiment may be equally applied to the description of the other configurations of this embodiment, as it is.

In this embodiment, a through-hole, not illustrated, is formed by penetrating through a central portion of the support substrate 200. The through-hole, not illustrated, is filled with a magnetic material of the body 100 to be described hereinafter to form a through-portion 110.

In this embodiment, a thickness of the nonmagnetic layer 400 is less than a thickness of the support substrate 200.

Referring to FIG. 4, based on a thickness direction Z of the body 100, a distance t2 from one surface of the support substrate 200 to an upper surface of a first coil portion 310 is shorter than a distance T2 from a portion of an insulating layer 500 disposed on the nonmagnetic layer 400 to an upper surface of the first coil portion 310. Although not illustrated in detail, based on the thickness direction Z of the body 100, a distance from the other surface of the support substrate 200 to a lower surface of a second coil portion 320 is similarly less than a distance from the insulating layer 500 to the lower surface of the second coil portion 320.

There may be a boundary surface between the nonmagnetic layer 400 and the support substrate 200. In this embodiment, the nonmagnetic layer 400 may be formed as an additional layer distinguished from the support substrate 200, such that a nonmagnetic layer 400 having a lower thickness than the support substrate 200 may be introduced below the through-portion 110. As described in the first embodiment, the nonmagnetic layer 400 may be introduced into the through-portion 110, such that resistance of a component may be increased to decrease a flux change rate and to improve DC-bias characteristics. However, since an area occupied by the body 100 in the entire component is decreased as much, inductance may be decreased. Accordingly, in this embodiment, the nonmagnetic layer 400 having a lower thickness than the support substrate 200 may be disposed below the through-portion 110 to implement target DC-bias characteristics while significantly reducing a decrease in inductance.

Third Embodiment

Figure 5:
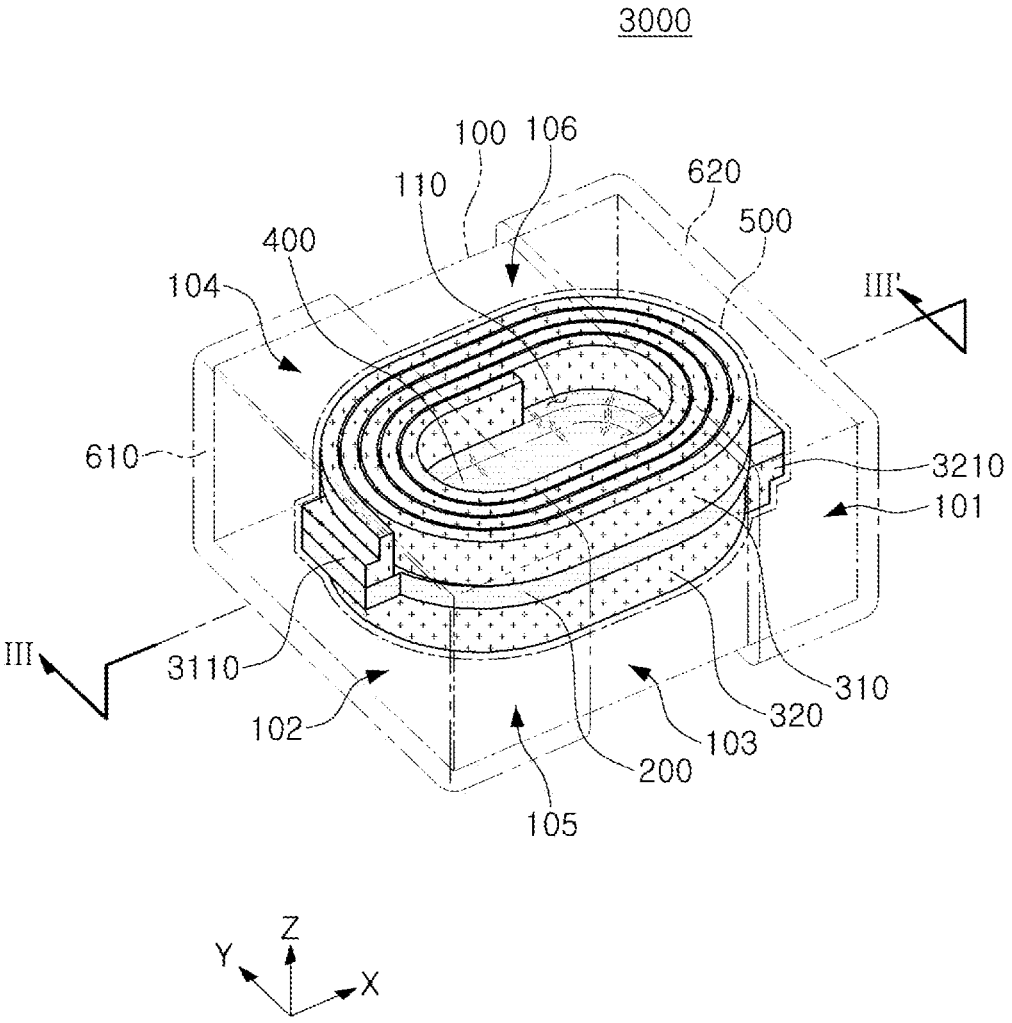
FIG. 5 is a schematic diagram of a coil component according to a third embodiment of the present disclosure.
Figure 6:
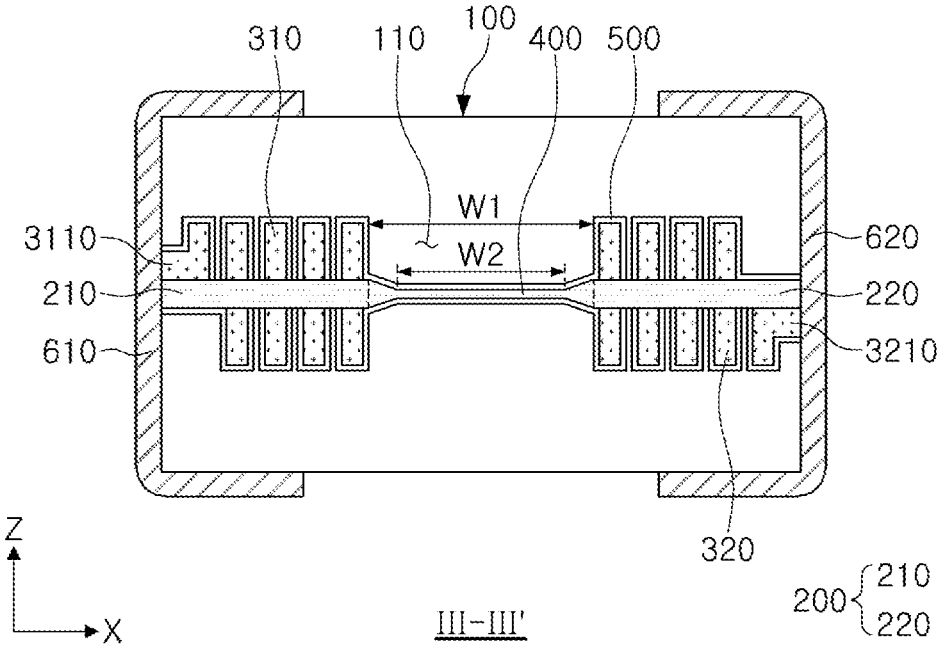
FIG. 6 is a cross-sectional view taken along line III-III' in FIG. 5.

FIG. 5 is a schematic diagram of a coil component according to a third embodiment, and FIG. 6 is a cross-sectional view taken along line III-III' in FIG. 5.

A coil component 3000 according to this embodiment is different from the coil component 1000 according to the first embodiment, in terms of a shape of a through-portion 110. Therefore, a description will be given of only the shape of the through-portion 110 different from that in the first embodiment. The description of the first embodiment may be equally applied to the description of the other configurations of this embodiment, as it is.

In this embodiment, widths W1 and W2 of the through-portion 110 are decreased in a direction toward a nonmagnetic layer 400.

Referring to FIG. 6, the width W2 of a portion of the through-portion 110, closest to the nonmagnetic layer 400, is less than the width W1 of a portion of the through-portion 110, relatively distant from the nonmagnetic layer 400. Although not illustrated in detail, based on the thickness direction Z of the body 100, a distance from the nonmagnetic layer 400 to upper surfaces of coil portions 310 and 320 is decreased in a direction toward the nonmagnetic layer 400. In this embodiment, a width of the through-portion 110 may be measured by measuring a width of a cross section of the through-portion 110 using an optical microscope. The width of the through-portion 110 may be measured by measuring a maximum value and a minimum value of the width of the through-portion 110 and calculating a median of the maximum and minimum values. The width of the through-portion 110 may refer to a dimension of the through-portion 110 in a horizontal direction, for example, in the length direction X as shown in FIG. 6 or in the width direction Y.

In this embodiment, in a process of trimming a support substrate 200, processing depth, strength, and the like, may be adjusted such that a thickness of the nonmagnetic layer 400 is gradually decreased in a direction toward the center of the through-portion 110. For example, the through-portion 110 has a concave shape as a width of the through-portion 110 is decreased in a direction toward a lower portion thereof. As a result, in this embodiment, target DC-bias characteristics may be implemented while significantly reducing a decrease in inductance. In addition, the nonmagnetic layer 400 may be formed while using processes of forming and processing the support substrate 200 as it is.

As described above, a coil component according to the present disclosure may decrease flux saturation velocity and implement target DC-bias characteristics without changing a material of a body.

While example embodiments have been shown and described above, it will be apparent to those skilled in the art that modifications and variations could be made without departing from the scope of the present disclosure as defined by the appended claims.

What is claimed is:

1. A coil component comprising:

a support substrate;

a coil portion including a plurality of turns disposed directly on the support substrate;

a magnetic body, in which the support substrate and the coil portion are disposed, having a through-portion penetrating through a center of the coil portion;

a nonmagnetic layer disposed below the through-portion; and an insulating layer disposed between the nonmagnetic layer and the through-portion, and extending from the coil portion to the nonmagnetic layer so that the insulating layer is in contact with an upper surface and a side surface of an innermost turn of the plurality of turns and the nonmagnetic layer, wherein the nonmagnetic layer has a thickness less than a thickness of the support substrate.

2. The coil component of claim 1, wherein, based on a thickness direction of the body, a distance from one surface of the support substrate, on which the turns of the coil portion are disposed, to an upper surface of the coil portion is greater than a distance from the insulating layer to the upper surface of the coil portion.

3. The coil component of claim 1, wherein thicknesses of the support substrate and the nonmagnetic layer are substantially the same.

4. The coil component of claim 1, wherein the insulating layer includes parylene.

5. The coil component of claim 1, wherein, based on a thickness direction of the body, a distance from one surface of the support substrate, on which the turns of the coil portion are disposed, to an upper surface of the coil portion is less than a distance from the insulating layer to the upper surface of the coil portion.

6. The coil component of claim 1, wherein a width of the through-portion is decreased in a direction toward the nonmagnetic layer.

7. The coil component of claim 1, wherein a boundary surface is disposed between the nonmagnetic layer and the support substrate.

8. The coil component of claim 1, wherein the nonmagnetic layer includes at least one of a polymer, a ceramic material, or alumina ($Al_2O_3$).

9. The coil component of claim 1, further comprising:

an external electrode disposed on an external surface of the body to be connected to an end portion of the coil component.

10. The coil component of claim 1, wherein the nonmagnetic layer extends from the support substrate.

11. The coil component of claim 10, wherein the nonmagnetic layer and the support substrate comprise the same material.

12. The coil component of claim 11, wherein each of the plurality of turns of the coil portion has one surface in contact with the support substrate, and another surface opposing the one surface and spaced apart from the support substrate.

13. A coil component comprising:

a support substrate;

a coil portion disposed on at least one surface of the support substrate;

a magnetic body, in which the support substrate and the coil portion are disposed, having a through-portion penetrating through a center of the coil portion;

a nonmagnetic layer disposed below the through-portion; and an insulating layer disposed between the nonmagnetic layer and the through-portion, wherein a portion of a surface of the nonmagnetic layer, on which the insulating layer is disposed, is inclined with respect to a stacking direction of the coil portion and the support substrate such that a width of the through-portion is decreased in a direction toward the nonmagnetic layer, the insulating layer extends from the coil portion to the nonmagnetic layer so that the insulating layer is in contact with an upper surface and a side surface of an innermost turn of a plurality of turns of the coil portion and the nonmagnetic layer, and the nonmagnetic layer has a thickness less than a thickness of the support substrate.

14. The coil component of claim 13, wherein the insulating layer extends along a surface of the coil portion.

15. The coil component of claim 13, wherein the insulating layer includes parylene.

16. The coil component of claim 13, wherein the nonmagnetic layer includes at least one of a polymer, a ceramic material, or alumina ($Al_2O_3$).

17. The coil component of claim 13, further comprising:

an external electrode disposed on an external surface of the body to be connected to an end portion of the coil component.

18. The coil component of claim 13, wherein the nonmagnetic layer extends from the support substrate, and comprises the same material as the support substrate.

* * * * *